United States Patent [19]

LeBlanc

[11] Patent Number: 4,696,271

[45] Date of Patent: Sep. 29, 1987

[54] FUEL INJECTION PUMP

[75] Inventor: Jean LeBlanc, Lyons, France

[73] Assignee: Robert Bosch GmbH, Stuttgart, Fed. Rep. of Germany

[21] Appl. No.: 861,307

[22] Filed: May 9, 1986

Related U.S. Application Data

[63] Continuation of Ser. No. 690,976, Jan. 11, 1985, abandoned.

[30] Foreign Application Priority Data

Jan. 11, 1984 [DE] Fed. Rep. of Germany ..... 3400612
Dec. 5, 1984 [DE] Fed. Rep. of Germany ..... 3444234

[51] Int. Cl.[4] ..... F02M 41/06

[52] U.S. Cl. ..... 123/299; 123/447; 123/450; 123/500

[58] Field of Search ..... 123/450, 447, 458, 457, 123/500, 300, 495, 299

[56] References Cited

U.S. PATENT DOCUMENTS

| | | | |
|---|---|---|---|
| 2,055,578 | 9/1936 | Hurst | 123/447 |
| 2,250,877 | 7/1941 | Pischinger | 123/447 |
| 2,810,375 | 10/1957 | Froehlich et al. | 123/447 |
| 3,456,629 | 7/1969 | Dangauthier | 123/299 |
| 3,592,568 | 7/1971 | Fenne | 123/447 |
| 3,667,438 | 6/1972 | Moulin et al. | 123/447 |
| 3,759,239 | 9/1973 | Regneault et al. | 123/447 |
| 4,029,071 | 6/1977 | Saito et al. | 123/447 |
| 4,505,244 | 3/1985 | Smith | 123/447 |
| 4,509,487 | 4/1985 | Mowbray | 123/458 |

FOREIGN PATENT DOCUMENTS

| | | | |
|---|---|---|---|
| 1576617 | 8/1973 | Fed. Rep. of Germany | 123/447 |
| 507940 | 6/1939 | United Kingdom | 123/299 |

*Primary Examiner*—Andrew M. Dolinar
*Attorney, Agent, or Firm*—Michael J. Striker

[57] ABSTRACT

A fuel injection pump has a work space which at a certain position of the pumping piston communicates with a tapping opening through which delivered fuel flows into an offtake space. The angular position at which the connection between the pumping space and the fuel offtake space is established, is adjustable in order to control the amount of injected fuel. The fuel offtake space is adjustable by means of a spring-biased piston. The position of the tapping opening to a distributing channel is adjustable by a movable supporting member communicating with a rotary distributor.

14 Claims, 9 Drawing Figures

FUEL INJECTION PUMP

This application is a continuation of application Ser. No. 690,976, filed Jan. 11, 1985, abandoned.

BACKGROUND OF THE INVENTION

The present invention relates in general to a fuel injection pump for an internal combustion engine and in particular to a pump of the type having at least one pumping piston delimiting a variable work space, a fuel injection conduit, distributing means for connecting the work space during each delivery stroke to the fuel injection conduit and, during each suction stroke, to a fuel storage space and having a relieving opening for connecting, at a certain point during the delivery stroke of the pumping piston, the work space of the pump to a fuel offtake space.

A fuel injection pump of this kind is known from the U.S. Pat. No. 3,988,287. This prior art pump is constructed as a reciprocating distributor type injection pump provided with a relieving channel which is arranged in the pump piston and branches from the work space of the pump. The relieving channel has a lateral outlet on the pumping piston and at a certain stroke piston of the latter communicates during each delivery stroke with a relieving conduit which in turn is connected via a variable and a fixed throttle with a relieving space of a constant volume. The reception capacity of this volume in this known fuel injection pump is set on the one hand, by the variable throttle which is adjustable in dependency on load and on the other hand, by the fixed throttle which acts on dependency on rotary speed. By means of this arrangement, a connection between the pumping work space and the fuel offtake space is to be established only during low rotary speeds and loads and the quantity of fuel per an angle of rotation or per a time unit is reduced at the beginning of injection, particularly during low rotary speeds and loads. This prior art arrangement of injection pump does not permit any universal application thereof. Also it cannot adjust for the overall operational range of the combustion engine the amount of a preliminary fuel injection before the actual main fuel injection and the time interval between the preliminary and main injections.

SUMMARY OF THE INVENTION

A general object of the present invention is to overcome the aforementioned disadvantages.

In particular, it is an object of the invention to provide an improved fuel injection pump of this type in which the time interval between the preliminary injection can be adjusted with sufficient accuracy in broad operational range of the combustion engine.

Another object of this invention is to control exactly the amount of the preliminary injection also in dependency on operational parameters of the engine and to change the quantity of the preliminary injection also during the operation of the fuel injection pump.

In keeping with these objects and others which will become apparent hereafter, one feature of the invention resides in a combustion in a fuel injection pump of the above described kind, which can be both a reciprocating or a radial piston distributor type pump, which comprises a fuel offtake device having a spring biased offtake piston delimiting a variable fuel offtake space, means for adjusting the stroke of the offtake piston, and distributing means of the pump including at least one relieving opening connecting, at a predetermined position of the pumping piston during its delivery stroke, the work space of the pump with the offtake space.

By means of the adjustable volume of the offtake space, a desired time interval of the preliminary injection before the main injection can be accurately set in broad operational conditions of the engine. The time point of the establishment of the connection between the pumping work space and the fuel offtake space determine also the amount of the preliminary injection which also depends on geometrical magnitudes which are independent from rotary speed.

In a preferred embodiment of this invention, the fuel offtake space is located in a shiftable part of the pump, the position of which can be adjusted by an adjuster in dependency on operational parameters of the engine so that a channel leading from the offtake space cooperates with an offtake opening moving in synchronism with the drive of the pump piston, and the offtake opening establishes a connection between the large space of the pump and the fuel offtake space. This arrangement makes it possible that the amount of preliminary injection can be exactly controlled also in dependency on the operational parameters of the engine and can be changed during the operation of the fuel injection pump. As mentioned before, the invention is also applicable for radial piston pumps without any substantial increase in manufacturing expenditures.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
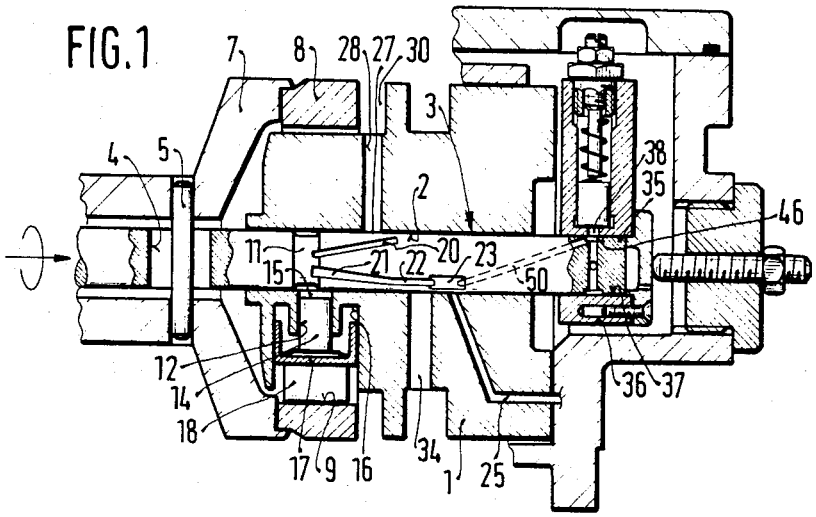
FIG. 1 shows in a longitudinal section a radial piston injection pump incorporating this invention.

The radial piston distributor type injection pump shown in FIG. 1 includes a cylinder housing 1 having a through-bore 2 in which a distributor 3 is supported for rotation. The distributor is rotated by a non-illustrated drive at a rotary speed of the pump. A cam ring support 7 is coupled to the distributor 3 by means of a carrier pin 5 which passes through an elongated guiding slot 4 in the distributor. The support 7 is connected at its rim with a cup-shaped cam ring 8 which on its inner surface is formed with radially inwardly shaped cam track 9. In this fashion, the cam track and the distributor are driven in synchronism and by means of a non-illustrated axial drive the distributor 3 is shiftable in axial direction in the range of the longitudinal slot 4 relative to the cam track 9.

The cylindrical jacket of the distributor 3 is formed with an annular groove 11 which permanently communicates with one or more cylindrical bores 12 formed in the cylinder housing 1 for guiding pumping piston 14, respectively. The end face of the pumping piston 14 delimits a work space 15 communicating with the annular groove 11. A recess 16 is formed in the cylinder housing 1 coaxially with the piston 14. The recess 16 is of larger diameter than the cylinder 12 and serves for guiding a plunger 17 connected to the pumping piston 14 and being in contact, via a roller 18, with the cam track 9. During the rotary movement of the cam track the plunger and hence the piston 14 are brought in a reciprocating movement determining the delivering and suction strokes of the pump.

The jacket of the distributor 3 is also formed with first control grooves 20 and second control grooves 21 opening into the annular groove 11 and diverging in axial direction from each other in a V-shaped pattern. The second control groove 21 exceeds in length the first control groove 20 whereby the exceeding part 22 of the second control groove is directed parallel to the axis of the distributor 3 and terminates in a control area 23 of a rectangular cross-section. The inlets of fuel injection conduits 25 opening into the axial bore 2 are arranged in a radial plane in the range of the rectangular control area 23 and are distributed around the circumference of the distributor. The number of injection conduits corresponds to the number and distribution of combustion spaces of the engine to be supplied with the fuel.

Figure 3:
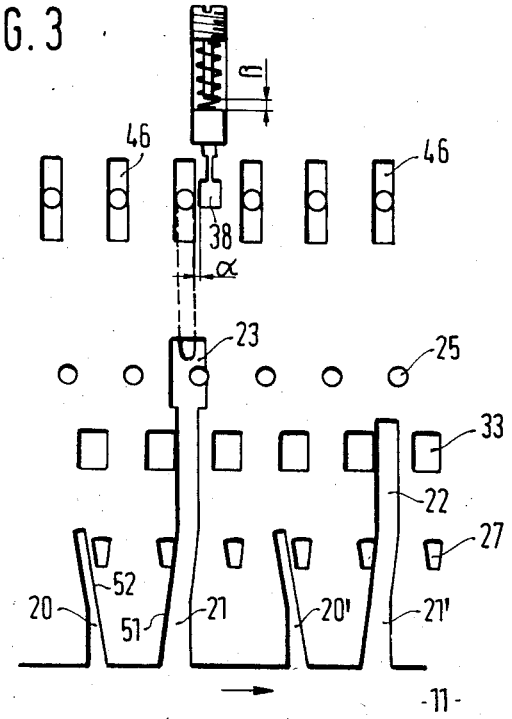
FIG. 3 is a simplified geometric development of the fuel distributing parts of the pump of FIG. 1.

In another radial plane in the range of shorter first control grooves 20, the cylinder housing is provided with a plurality of control openings 27 communicating via conduits 28 with a fuel storage space 30. The latter space is supplied in conventional manner with fuel by a non-illustrated fuel supply pump which operates at a relatively low pressure level. The distribution of the control openings 27 corresponds to the number of fuel injection conduits communicating with the axial bore 2 in the first mentioned radial plane. The cross-section of the control openings 27 is illustrated in FIG. 3 showing the geometric developments of the axial bore 2 and of the jacket of the distributor 3. The control openings 27 have substantially a trapezoidal configuration with converging lateral sides whose angle corresponds to the angle of inclination of the first control groove 20 at one side and to the angle of inclination of the second control groove 21 at the other side. The cylinder housing 1 is further provided with a rectangular fuel inlet openings 33 of passages 34 communicating with the axial bore 2 in a third radial plane in the range of the axially parallel portion 22 of the second control grooves 21. The number and distribution of the filling passages 34 around the axial bore 2 corresponds to the number and distribution of control openings 27. The inlet opening 33 of the passages 34 are closed simultaneously with the closing of control openings 27 after the second control groove 21 has passed out of the range of these openings. The filling channels 34 are also connected to the fuel storage space 30.

The distributor 3 has an end portion 35 projecting from the axial bore 2. The end portion 35 supports a ring-shaped slider 36 formed with a radial access channel 38 communicating at one end thereof with the inner surface of the slider and at the other end with a cylinder 40 of an attachment 39 on the outer surface of the slider. The cylinder 40 guides for a reciprocating movement a piston 41 which is biased by resetting spring 42 and delimiting at its end face opposite the radial channel 38 a fuel offtake space 43. The stroke of the piston 41 is adjustable by a setting screw which is provided with a stop pin 45 extending coaxially with the helical resetting spring 42.

The axial position of the ring shaped slider 36 relative to the distributor is adjustably fixed. In the range of the slider, the distributor is provided with fuel offtake openings in the form of elongated grooves 46 extending in axial direction of the distributor as shown in FIG. 3. The number and distribution of these fuel offtake grooves 46 correspond also to the number and distribution of fuel injection conduits 25 on the circumference of the distributor. The elongated fuel take-off grooves 46 are interconnected by radial bores 49 which in turn are connected via a pressure channel 50 in the distributor with rectangular control area 23 and via control grooves with the annular groove 11 or with the work space 15 of the pump.

Figure 4:
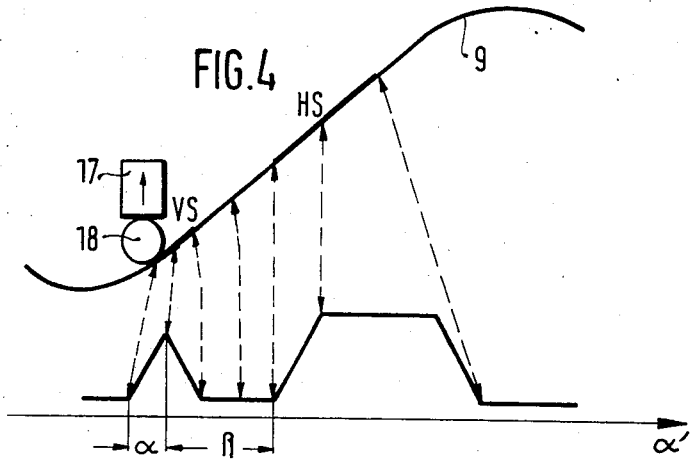
FIG. 4 shows schematically a lighting part of the course of the cam for the pumping piston of the embodiment of FIG. 1 illustrated in conjunction with a diagram showing the quantity of injected fuel versus angle of rotation.

The operation of the fuel injection of FIG. 1 will be now explained with reference to the development of FIG. 3, whereby it is assumed that the positioned of the ring shaped slider 36 is fixed. From the geometric development it will be recognized that the fuel injection pump in this example serves for supplying fuel to a six cylinder combustion engine having six fuel injection conduits 25. In order to improve the alternating filling of the work spaces 15 of the pump, in this example, there are provided two first control grooves 20 and two second grooves 21 whereby only one of the second grooves 21 is provided with the control area 23. In the position of the pump shown in FIG. 3, the filling of work spaces with fuel is completed and the actual fuel delivery cycle of the pump piston 14 begins. At this time point, the control area 23 encloses the inlet of one of the fuel injection conduits 25 into which fuel is to be delivered. The momentary active elongated groove 46 connected through the pressure channel with the control area 23 does not yet overlap the opening of the radial channel 38 in the inner surface 37 of the slider. During the angular range $\alpha$ over which the distributor 3 has to rotate in order to reach the overlap of the elongated groove 46 with the channel 38, a preliminary fuel injection takes place as indicated in the graph of FIG. 4. FIG. 4 illustrates a rising portion of the cam track 9 with indicated plunger 17 which is in contact with the cam via a roller 18. Full lines on the cam track indicate the track portions during which the preliminary fuel injection VS and the main fuel injection HS take place. The graph below the cam curve illustrates the plot of fuel quantity versus angular movement $\alpha'$ of the cam track. As soon as the elongated groove 46 advances into alignment with the channel 38, a pressure difference causes the fuel to flow in the offtake space 43 which takes off fuel delivered by the pumping piston 14. As soon as the offtake space 43 is filled up to its capacity, pressure in the work space 15 starts building up again and consequently the delivered fuel is being discharged during the main injection phase HS so long until the first control grooves 20 overlap the control opening 27. Then the fuel injection is interrupted and a residual amount of delivered fuel is transferred into the storage space 30. At this point when the axially directed part 22 of the second control groove 21 overlaps the inlet opening 33 of passages 34, pressure in the offtake space 43 drops and the off-take piston 41 returns by the action of biasing spring 42 to its initial position. In the course of further rotary movement of the distributor also the first control grooves 20 are brought over the control openings 27 and consequently sufficiently large filling cross-section is available during the subsequent suction cycle of the pump piston. Fuel can flow in the work space of the pump both through the first control grooves and through the second control grooves due to open control openings 27 and inlet openings 33.

From the above description it will be recognized that the trailing limiting edge of the second control grooves 21 which is inclined in the direction of rotation of the distributor acts as a first control edge 51 determining the beginning of injection whereas the leading limiting edge of the first control groove which is inclined counter the direction of rotation acts as a second control edge 52 determining the end of the injection. As a consequence, the distance between the first control edge 51 and the second control edge 52 in range of the radial plane of the control openings 27 determines also the quantity of injected fuel. This injected quantity, due to diverging arrangement of the control edges 51 and 52 can be changed by axial displacement of the distributor 3.

Figure 5:
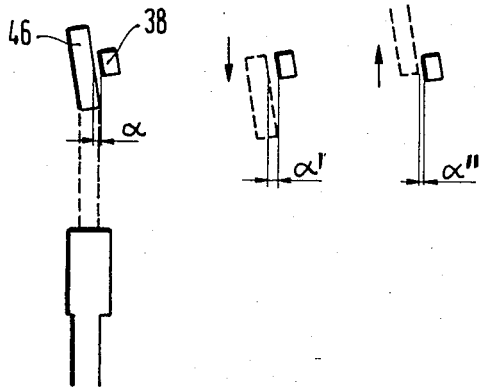
FIG. 5 is a partial development of the distributing parts in a modification of the embodiment of FIG. 1.

The angular range between the preliminary injection VS and the main injectin HS is affected by absorbing capacity of the fuel offtake space 43 which can be adjusted by the setting pin 45. The quantity of the preliminary fuel injection, as mentioned before, is determined by the magnitude of the angle of rotation which as illustrated in FIG. 5, can be changed in dependency on load. In this variation of the invention, the fuel pumping openings or elongated grooves 46 are inclined to the axis of the distributor whereby the lateral sides of the radial channel 38 which in this embodiment has also a rectangular crosssection are also inclined in accordance with the corresponding sides of the groove 46. FIG. 5 illustrates three different axial positions of the distributor 3. It will be seen that depending on the axial position of the distributor, the angle $\alpha$ is changed and accordingly, the preliminary fuel injection can be adjusted to momentary load of the combustion engine. The preliminary fuel injection can be changed in direct proportion to the main injection or if desired in inverse proportion to the latter, depending on the inclination of the elongated grooves 46.

In the preceding example, there is disclosed a radial piston pump having an axially shiftable distributor in which the number and distribution of fuel offtake openings 46 correspond to the number and distribution of fuel injection conduits in the distributor. In the same manner, it is of course possible to provide the distributor with only a single fuel offtake opening while the inner wall 37 of the annular slider 36 is provided with a plurality of fuel offtake openings whose number corresponds to that of combustion spaces of the engine. The latter fuel offtake openings are then in continuous connection with the fuel offtake space 43.

The same concept can be realized also in the case of a reciprocating piston pump where no elongated grooves acting as fuel offtake openings are necessary or needed inasmuch due to the reciprocating movement of the piston a point is determined at which the connection between the work space of the pump and the fuel offtake space 43 can be established.

Figure 2:
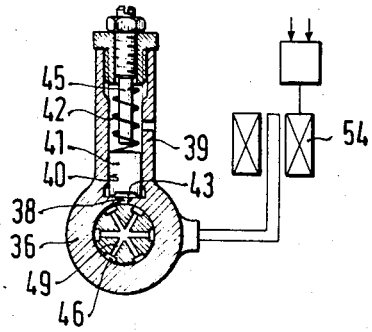
FIG. 2 is a transverse section of a fuel offtake device of the pump of FIG. 1, shown with modified position shifting means.

Another modification of the invention is illustrated in FIG. 2 where the ring shaped slider 36 is axially fixed and its angular position is adjustable by means of an electrically controlled adjuster 54. The adjuster varies the point at which the fuel offtake opening 46 connects the work space of the pump with the fuel offtake space. There is also possible to provide for an additional adjustment of the amount of the preliminary injection in dependency on further parameters of the engine and independently on the before described mode of operation. For instance, the fuel offtake opening used in a radial piston pump can be also designed as inclined elongated grooves 46. Instead of a rotary drive for the ring shaped slider it is also possible to provide a reciprocating drive imparting an axial shift. In the latter case, the elongated grooves 46 must be inclined in order to enable the adjustment of the amount of the preliminary injection. This modification can be also realized in the case of reciprocating or in-line piston pumps.

Figure 6:
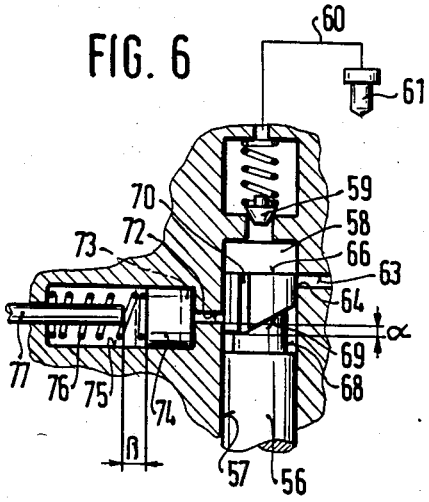
FIG. 6 is a sectional view of a cut-away part of an inline or reciprocating piston pump incorporating this invention.

FIG. 6 illustrates the application of an embodiment of this invention in an in line or reciprocating piston pump. Of the plurality of in line pistons only one pumping piston 56 is shown which in conventional manner is set by means of a cam and a cam driving shaft in a reciprocating pumping movement. The pumping piston delimits in a cylinder 57 a work space 58 of the pump. The work space is connected via a pressure valve 59 and an injection conduit 60 to an injection valve 61 assigned to a cylinder of the internal combustion engine. A filling and discharging conduit 63 which is connected to a fuel supply pump, opens in conventional manner into the injection pump cylinder 57. The opening 64 of this filling and discharging conduit is controlled by the edge of the end wall 66 of the injection pump piston in such a way that the work space 58 of the injection pump is filled up with fuel from the conduit 63 before the bottom dead center of the piston 56 when the opening 64 is fully opened. The effective delivery stroke of the injection pump piston 56 starts when the opening 64 of the fuel supply conduit is fully closed. In order to determine this effective delivery stroke for fuel to be injected the injection pump piston is provided in a known manner with an annular groove 68 whose boundary edge which is close to the work space is formed as an oblique control edge 69. The annular groove 68 is permanently connected via an axially directed groove 70 with the work space 58 of the injection pump. After the beginning of the effective delivery stroke, that means after the closing of the opening 64 of the fuel supply conduit 63, the piston of the fuel injection pump delivers fuel under high pressure into the injection conduit 60 so long until the oblique or inclined control edge 69 crosses the opening 64 of the fuel supply conduit 63 and the work space 58 is unloaded via the axial groove 70, the annular groove 68 and the filling and discharging conduit 63. At this instant high pressure fuel delivery is interrupted and the injection through the value 61 is completed. The injection piston pump 56 is also equipped with a conventional, nonillustrated turning device which controls the orientation of the inclined control edge 69 relative to the opening of the filling and discharging conduit 63 in such a manner that a most effective delivery stroke and quantity of injected fuel is achieved.

In addition, a radially directed channel 72 leads to a fuel tapping or fuel offtake space 73 which is constructed in the same fashion as in the embodiments of FIG. 1 or 2 and is bounded by a piston 74 which is moveable into opposite directions in a cylinder 75. The end wall of the piston 74 remote from the offtake space 73 is acted upon by a biasing spring 76 arranged in the cylinder 75. An adjustable stop rod 77 projecting into the cylinder 75 delimits the maximum stroke $\beta$ of the fuel stepping piston 74. In a modification, instead of a reciprocating piston 74, there can be used also a moveable wall for shutting the fuel offtake space 73 (or 43).

Figure 7:
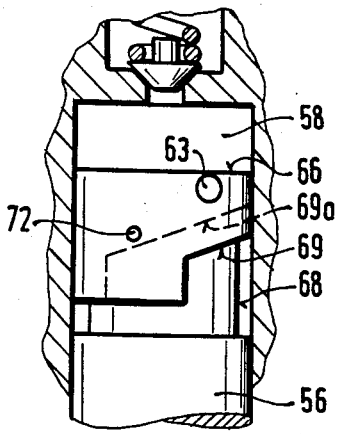
FIG. 7 is a side view of a detail of the pump of FIG. 6, shown on an enlarged scale.

The opening of the radial channel 72 into the cylinder 57 of the injection pump is located at a point where the communication with the annulur groove 68 of the piston 56 is established only after a part $\alpha$ of the delivery stroke when the opening 64 of the fuel supply and discharge conduit is still closed by the jacket of piston 56. At this location of the channel 72 fuel is charged in the offtake space 73 so long until the piston 74 abuts against the stop rod 77 and the fuel volume of the variable offtake space 73 is reached. As a result, the fuel injection process achieves a uniform characteristic as it has been described in the preceding example in connection with FIG. 4. In this exemplary embodiment the position of the channel 72 is invariable but a load dependent control of the quantity of the preliminary fuel tapping is adjusted by the magnitude of the partial delivery stroke $\alpha$. As it will be seen in FIG. 7, the opening of the radial channel 72 is situated relative to the inclined control edge 69 on the piston 56 such that in dependency on the annular position of the piston 56 about its center axis the communication between the channel 72 and the annular groove 68 is established either after a shorter or a longer partial stroke after the onset of the pumping or delivery stroke. The annular position of the piston 56 of the injection pump corresponding to a shorter distance between the inclined control edge 69a and the opening of the channel 72, is indicated is indicated by dashed lines in FIG. 7.

Figure 8:
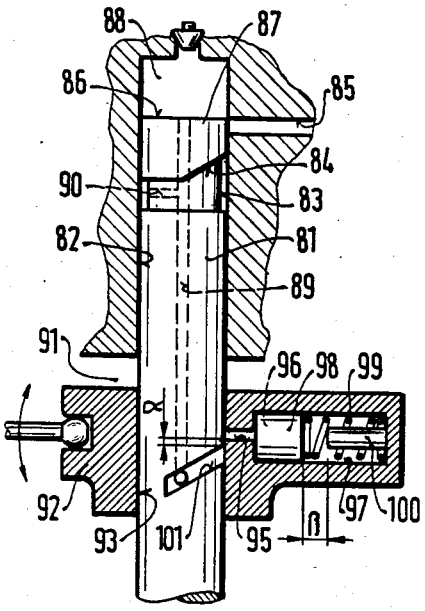
FIG. 8 is a sectional view of still another embodiment of this invention in an in-line or reciprocating piston pump.

A further modification of this invention is shown in FIG. 8, also in connection with an in line or reciprocating piston pump. Of the plurality of reciprocating pistons, only one piston 81 of the fuel injection pump is shown arranged for performing a reciprocating movement in a cylinder 82 to produce delivery or suction strokes of the pump. Also in this embodiment, the piston 81 is formed with annular groove 83 having an oblique or inclined control edge 84 which cooperates with the opening of a filling and discharging conduit 85 leading to a fuel supply pump. The opening of the conduit 85, similarly as in the preceding example, is controlled by a control edge at the rim of the end face of the piston 81. The control edge 86 determines the suction or filling of the work space 88 of the injection pump and also the begining of effective delivery of the fuel after the opening of the conduit 85 is closed. The annular groove 83 of the piston 81 is continuously connected via a radial bore 90 and an axial or central bore 89 with the work space 88 of the pump.

A part of the piston 81 projects in a space 91 in the interior of the fuel injection pump. In this space, the piston 81 drives an annular slider 92 slideably arranged thereon in similar fashion as in the embodiment according to FIGS. 1 or 2. The inner wall 93 of the annular slider which is tightly guided on the piston 81, is provided with radially directed channel 95 which corresponds in function to the channel 38 in the embodiment of FIG. 3. The channel 95 opens in a fuel offtake space 96 in a cylinder 97 which is adjustable in volume by a moveable wall or piston 98. The piston 98 which delimits the fuel offtake space 96 is again spring biased by a resetting spring 99 and its stroke is limited by a stop 100 to move against the force of the biasing spring by a distance $\beta$.

In the range of the inner bore 93, the piston 81 of the fuel injection is provided with an oblique groove 101 communicating via the axial bore 89 with the work space 88 of the cylinder 82.

The annular slider 92, similarly as the slider in the embodiment of FIGS. 1 or 2, is adjustable in position by an adjusting device which can displace the slider in axial direction or in annular direction or in both direction, depending on operational parameters of the engine which control the adjusting device. The inclined shape of the groove 101 permits for example the pure rotary movement of the annular slider 92 so that by rotating the annular slider and/or by rotating the piston 81 according to its load condition, a larger or smaller preliminary fuel tapping partial stroke $\alpha$ is effected until a connection between the channel 95 and the annular groove 101 is established. For example, through the inclined groove 101 the fuel injection process can be influenced in dependency on load. If desired, the effects of load on the injection process can be intentionally compensated by a corresponding rotation of the annular slider. Additional influences on the injection can be taken up by an axial displacment of the annular slider.

Figure 9:
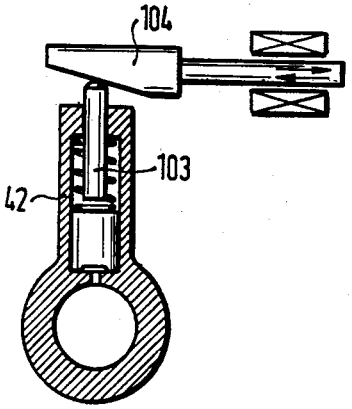
FIG. 9 shows a modification of the embodiments of FIGS. 1 and 8.

In the embodiment of FIG. 9 there is shown a variation of the construction of the adjustable stop member 45 according to FIGS. 1, 2, 6 and 8. Instead of making the stop rod 45 in the form of a threaded rod whose screwed-in position is guarded by a nut, the stop member 103 in FIG. 9 is in the form of a pin 103 which is slideably guided in the annular slider to immerse coaxially in the cylinder 42 of the fuel offtake device. The projecting end of the stop pin 103 slideably engages a wedge 104 whose position is controlled by electric means. In this way during the continuous operation of the pump the magnitude $\beta$ of the distance between the preliminary fuel takeoff and the main fuel injection, can be varied.

It will be understood that each of the elements described above, or two or more together, may also find a useful applciation in other types of constructions differing from the types described above.

While the invention has been illustrated and descirbed as embodied in specific examples of the fuel injection pump, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A fuel injection pump for internal combustion engines, comprising at least one pumping piston delimiting a variable work space, connecting means rotating in synchronism with said pumping piston to connect the work space during each delivery stroke to a fuel injection conduit and during each suction stroke to a fuel storage space, means for adjusting the axial position of said connecting means relative to said fuel injection conduit and said fuel storage space according to a desired duration of main fuel injection; means for varying strokes of said pumping piston according to a desired duration of preliminary fuel injection; a fuel offtake device including a fuel offtake space provided with an access channel, a movable wall for varying the volume of said fuel offtake space, biasing means for displacing said movable wall toward said access channel into a limit position in which said fuel offtake space has a minimum volume, abutment means for limiting the movement of said movable wall in the direction away from said access channel, said connecting means including at least one control passage for connecting, from a predetermined position of the pumping piston during each delivery stroke, the work space of the pump with said access channel; and means for adjusting the position of said fuel offtake device relative to said connecting means whereby fuel delivered after a partial pumping stroke which is variable according to predetermined operational parameters, acts on said movable wall to establish a connection between said work space and said variable fuel offtake space.

2. A fuel injection pump as defined in claim 1, comprising a movable support for the fuel offtake device, an adjuster for adjusting the position of the support in dependency on predetermined operational parameters of the engine, said control passage including a tapping opening cooperating with a channel in the movable support and leading to the fuel offtake space, the spacing between the tapping opening and the channel being adjustable by said adjuster so as to establish a connection between the work space of the pump and the fuel offtake space from a position during the delivery stroke of the pumping piston.

3. A fuel injection pump as defined in claim 2, wherein the movable support is shiftable in the direction of movement of the tapping opening.

4. A fuel injection pump as defined in claim 2, wherein the movable support is movable at right angle to the direction of movement of the tapping opening.

5. A fuel injection pump as defined in claim 3, wherein one of the tapping openings and the inlet opening of the channel have elongated rectangular cross-sections.

6. A fuel injection pump as defined in claim 4, wherein one of the tapping openings and the inlet of the channel have elongated rectangular cross-sections.

7. A fuel injection pump as defined in claim 6, wherein the sides of the tapping opening are inclined relative to the direction of movement of said support.

8. A fuel injection pump as defined in claim 2, the fuel injection pump being a rotary piston type comprising a rotary distributing member rotating in synchronism with the drive of the pump piston, the pump having a plurality of fuel injecting conduits having their inlets distributed around the rotary distributing member in the range of a control area so that during the delivery stroke of the pumping piston the control area successively overlaps one of the inlet openings, the control area being in permanent connection with the work space, the rotary distributing member guiding said movable support in axial direction, the distributing member having said at least one tapping opening arranged in the range of the inlet of the channel leading to the offtake space, the number and distribution of said tapping opening and inlet of the channel being such that at each pumping stroke a connection between said channel and said work space may be established.

9. A rotary piston type fuel injection pump for internal combustion engines, having at least one pumping piston delimiting a variable work space, connecting means arranged for connecting the work space during each delivery stroke to a fuel injection conduit and during each suction stroke to a fuel storage space, a fuel offtake device including a spring biased movable wall delimiting a variable fuel offtake space, means for adjusting the stroke of the movable wall, the connecting means including at least one controlled passage connecting, from a predetermined position of the pumping piston during its delivery stroke, the work space of the pump with the fuel offtake space, the connecting means establishing a connection between said work space and said offtake space after onset of the pumping stroke of said pumping piston and after a partial pumping stroke the amount of which is variable according to predetermined operational parameters, a movable support for the fuel offtake device, an adjuster for adjusting the position of the support in dependency on predetermined operational parameters of the engine, said control passage including a tapping opening cooperating with a channel in the movable support and leading to the fuel offtake space, the spacing between the tapping opening and the channel being adjustable by said adjuster so as to establish a connection between the work space of the pump and the fuel offtake space from a position during the delivery stroke of the pumping piston, comprising a rotary distributing member rotating in synchronism with the drive of the pumping piston, the pump having a plurality of fuel injecting conduits having their inlet distributed around the rotary distributing member in the range of a control area so that during the delivery stroke of the pumping piston the control area successively overlaps one of the inlet openings, the control area being in permanent connection with the work space, the rotary distributing member guiding said movable support in axial direction, the distributing member having said at least one tapping opening arranged in the range of the inlet of the channel leading to the offtake space, the number and distribution of said tapping opening and inlet of the channel being such that at each pumping stroke a connection between said channel and said work space may be established, and wherein the movable support is provided with a plurality of channels leading to the offtake space, the number and distribution of the fuel injection conduits, and the rotary distribution member having a single tapping opening cooperating with the inlets of said channels.

10. A rotary piston type fuel injection pump for internal combustion engines, having at least one pumping piston delimiting a variable work space, connecting means arranged for connecting the work space during each delivery stroke to a fuel injection conduit and during each suction stroke to a fuel storage space, a fuel offtake device including a spring biased movable wall delimiting a variable fuel offtake space, means for adjusting the stroke of the movable wall, the connecting means including at least one controlled passage connecting, from a predetermined position of the pumping piston during its delivery stroke, the work space of the pump with the fuel offtake space, the connecting means establishing a connection between said work sapce and said offtake space after onset of the pumping stroke of said pumping piston and after a partial pumping stroke the amount of which is variable according to predetermined operational parameters, a movable support for the fuel offtake device, an adjuster for adjusting the position of the support in dependency on predetermined operational parameters of the engine, said control passage including a tapping opening cooperating with a channel in the movable support and leading to the fuel offtake space, the spacing between the tapping opening and the channel being adjustable by said adjuster so as to establish a connection between the work space of the pump and the fuel offtake space from a position during the delivery stroke of the pumping piston, comprising a rotary distributing member rotating in synchronism with the drive to the pumping piston, the pump having a plurality of fuel injecting conduits having their inlets distributed around the rotary distributing member in the range of a control area so that during the delivery stroke of the pumping piston the control area successively overlaps one of the inlet openings, the control area being in permanent connection with the work space, the rotary distributing member guiding said movable support in axial direction, the distributing member having said at least one tapping opening arranged in the range of the inlet of the channel leading to the offtake space, the number and distribution of said tapping opening and inlet of the channel being such that at each pumping stroke a connection between said channel and said work space may be established, the pump having a cylinder housing formed with cylinders accommodating the pumping pistons, an axial passage accommodating the rotary distributing member, a cam track arranged in the range of the pumping pistons for actuation of the pumping pistons synchronously with the rotation of the distributing member, the distributing member having on its surface at least first control edge and at least one second control edge both being boundaries of at least one groove being is continuous connection with the work space of the pump via an annular groove, the first and second control edges being inclined one to another and cooperating with control openings formed in the cylinder housing and communicating with a fuel storage space, whereby the first control edge determines the end of fuel delivery and the second control edge determines the beginning of the fuel delivery.

11. A rotary piston type fuel injection pump as defined in claim 10 wherein said first control edge is a boundary edge of a first control groove and said second control edge is a boundary edge of a second control groove diverging from said first control groove, and the control groove communicating via the control area with the consecutive tapping openings.

12. A rotary piston type fuel injection pump as defined in claim 11 wherein cylinder housing is provided with a plurality of control openings communicating with the rotary distributing member in the range of the first and second control grooves, the control openings leading to the fuel storing space, the openings having two opposite sides inclined in accordance with diverging control edges of the control grooves, and filling openings arranged between the control and tapping openings and communicating with the fuel storing space, the filing openings cooperating with the second control grooves during the suction stroke of the pumping piston.

13. A fuel injection pump for internal combustion engines, having at least one pumping piston delimiting a variable work space, connecting means arranged for connecting the work space during each delivery stroke to a fuel injection conduit and during each suction stroke to a fuel storage space, a fuel offtake device including a spring biased movable wall delimiting a variable fuel offtake space, means for adjusting the stroke of the movable wall, the connecting means including at least one controlled passage connecting, from a predetermined position of the pumping piston during its delivery stroke, the work space of the pump with the fuel offtake space, the connecting means establishing a connection between said work space and said offtake space after onset of the pumping stroke of said pumping piston and after a partial pumping stroke the amount of which is variable according to predetermined operational parameters, comprising a cylinder for guiding said pumping piston and delimiting therewith said workspace, said pumping cylinder being rotatable about its center axis and being provided on its jacket with a annular groove, said groove permanently communicating via a passage with said workspace and one of its edges transiting into a control edge portion, said cylinder having a fuel filling and discharging opening cooperating with said control edge portion so as to control the time point of the intake and discharge of fuel from the workspace according to the angular position of the pumping piston about its center axis, a part of said pumping piston projecting from the cylinder and being provided with a recess which permanently communicates with said workspace, a separate housing part having a bore which slidably receives said projecting part of the pumping piston, said fuel offtake space being arranged in said separate housing part and communicates with said bore via a connection channel whose opening in the bore cooperates with said recess.

14. A fuel injection pump as defined in claim 13 wherein at least one of limiting edges of said recess and of said control edge portion on the jacket of the pumping piston are inclined relative to the center axis of the latter.

* * * * *